United States Patent [19]

Gauvry et al.

[11] 3,955,262

[45] May 11, 1976

[54] BLANKS FOR WIREDRAWING BY IMPACT

[75] Inventors: Robert Gauvry, Paris; Robert Portalier, Ville d'Avray, both of France; Constantin Catsaros, Athens, Greece

[73] Assignee: Societe de Vente de l'Aluminum Pechiney, Paris, France

[22] Filed: May 7, 1974

[21] Appl. No.: 467,640

[30] Foreign Application Priority Data

May 9, 1973 France ..... 73.16624

[52] U.S. Cl. ..... 29/190; 72/274

[51] Int. Cl.[2] ..... B21C 1/00

[58] Field of Search ..... 29/190, 183; 75/138; 72/274

[56] References Cited

UNITED STATES PATENTS

| | | | |
|---|---|---|---|
| 3,219,491 | 11/1965 | Anderson et al. | 148/11.5 |
| 3,676,111 | 7/1972 | Wieser et al. | 75/142 |
| 3,857,705 | 12/1974 | Miyasaka et al. | 75/138 |

*Primary Examiner*—L. Dewayne Rutledge
*Assistant Examiner*—E. L. Weise
*Attorney, Agent, or Firm*—McDougall, Hersh & Scott

[57] ABSTRACT

The invention relates to blanks made of aluminum or aluminum base alloys for wiredrawing by impact, and to their method of obtaining same. These new blanks are obtained by casting and cooling under pressure, and are characterized by a fine and homogeneous grain, a crystalline structure with axial symmetry and an almost complete absence of pinholes, occlusions of a gaseous nature, and basaltic crystalline formations. They are intended for the fabrication by impact wiredrawing of such containers as tubes, carrying cases, boxes, packaging material, aerosol bombs, extinguisher bodies, bodies of bottles or cartridges for compressed or liquefied gases.

1 Claim, 5 Drawing Figures

BLANKS FOR WIREDRAWING BY IMPACT

This invention relates to blanks of aluminum or aluminum alloy, intended for the fabrication by wiredrawing methods, particularly wiredrawing by impact, of very diverse containers, such as tubes, carrying cases, boxes, packaging material, aerosol bombs, bodies of fire extinguishers, bodies of bottles or cartridges for compressed or liquefied gases, as well as to a method for obtaining such blanks.

"Aluminum alloy," as used hereinafter, shall refer to aluminum itself in its different commercial qualities, containing the usual impurities, and particularly iron and silicon, whose aluminum content generally is equal to or above 99 percent, as well as the light alloys in which aluminum is the principal component.

It is well known that blanks for wiredrawing generally are obtained by cutting into rolled strips. While this method of production allows for high production rates, at least for blanks of moderate thickness, it presents numerous inconveniences: the presence of burrs from cutting over the circumference of the blank requires removal of such burrs or drum polishing prior to the wiredrawing; the presence of a fibrous structure of the metal in the rolling direction, causing a high anisotropy of the blank which manifests itself during wiredrawing by typical defects; the ovalizaton of the wiredrawn cases, the formation of horns which, even after clipping of the end, may reappear during a tapering or a capping of said wiredrawn cases or tubes, differences in the texture of the grains on top of the cylindrical part, caused by the cutting of the blank and changing the appearance of the finished product. Moreover, the obtaining of thick blanks requires high power cutting presses which are expensive and have a relatively low production rate. Finally, this method makes it possible only to obtain blanks with parallel sides.

It should also be noted that after cutting the blanks into a laminated strip, an important reject remains which must be recast and which, according to the geometric shape of the blank, may represent a weight equal to or even higher than that of the cut blanks.

To remedy these defects, it has been proposed to fabricate these blanks by shell casting. This avoids the lamination, cutting and burr removing steps and the structure of the blank should be isotropical, basically. However, such a method still contains numerous inconveniences: the crystalline structure of the cast blank generally is too rough, and at the time of the cooling of the aluminum alloy, a more or less large piping forms which may cause, during the wiredrawing, serious defects, so that the wiredrawn part becomes unusable.

Vacuum or pressure casting systems likewise have been proposed. In certain ones of these systems, the mold is separated from the metal injecion system immediately at the end of the filling, and the blank is inevitably affected by a piping. In another case, for example in the method described in the French Pat. No. 1,589,521, the mold remains in one piece with the injection system during cooling; the piping is avoided basically, but the release from the mold requires shearing of the metal which has solidified in the injection channel. This latter solution is admissible only for blanks of small dimensions and adapts itself poorly to high production rates. It also is known that the pressure-cast parts frequently present very small gaseous occlusions which generally are immaterial for solid parts, but have a disastrous effect when it is desired to obtain carrying cases with thin walls by wiredrawing.

The present invention which makes it possible on an industrial level to obviate the inconveniences of the prior art has the following objectives:

1. New wiredrawing blanks of aluminum alloy which has undergone a preceding refining treatment, characterized by a fine, dense crystalline structure with axial symmetry, which is substantially homogeneous, and by a reduced extension of the rough basaltic crystallization which, at no point, reaches the peripheral zone.

2. A method for obtaining said blanks by gravity casting in a mold with high heat conductivity, cooled from the bottom surmounted by two removable heat-insulated covers and/or heated by a gas burner or any other equivalent means, permitting the formation of a feed head, the solidification of which is delayed in relation to the solidification of the blank contained in the mold and upon which, upon having begun the solidification of the blank, a moderate pressure is exerted, ranging between 0.1 and 5 bars, preferably between 0.2 and 1 bar, so that the metal of the still liquid feed head is forced, on the one hand, into the pipes of the blank which thus are filled as they tend to form and, on the other hand, they are destroyed by the amount of heat and the circulation currents the metal creates, the basalt structures which tend to form, thus giving the blank the most favorable structure for wiredrawing by impact or shock.

Indeed, it has been determined, as a result of numerous tests, that the most favorable structure for shock or impact wiredrawing blanks should be characterized by:

- a great fineness and homogeneity of the grain,
- a practically symmetrical crystalline structure in relation to the wiredrawing axis,
- almost complete absence of internal defects, such as pipes and micro pipes, cracks, blisters or blowholes, gaseous occlusions, dislocations, basalt formations.

The fineness and homogeneity of the grain generally are obtained, according to the invention, by a conventional refining treatment known per se of the aluminum or the aluminum base alloy. A particularly efficacious refining consists of mixing sodium and/or potassium fluoborate and fluotitanate, added in such proportions that the final contents of titanium and boron in the aluminum are from 0.01 to 0.10 percent respectively, and preferably from 0.03 to 0.07 percent titanium and from 10 to 100 ppm, preferably from 20 to 50 ppm of boron. An excess of refining product may lead to the formation of numerous inclusions of titanium diboride which would be present as many defects in the thin walls of the wiredrawn cases.

For certain aluminum alloys, for example with a high silicon content, it also is known to apply refining or "modification" treatments with sodium or antimony.

The symmetrical structure, in relation to the wiredrawing axis, which is the objective of the invention, is necessary to obtain an isotropical flow at the time of wiredrawing. Otherwise characteristic defects, called "ears" or "horns" are obtained which manifest themselves by differences in height of the wiredrawn cases along their upper circumference which makes it necessary to carry out a clipping operation, thus requiring an additional operation and loss of material.

The internal defects, such as pipes, cracks, blowholes, gaseous occlusions, dislocations are particularly unpleasant for producing cases with relatively thin walls (thickness from one to several tenths of a millimeter) which must withstand an internal pressure, like aerosol bombs or liquefied gas cartridges. This may result in a high rate of rejects.

The crystalline structures, called "basaltic" by analogy with the geologic formation bearing this name and which is characterized by a tying of thick very elongated crystals and aligned along a major dimension, are particularly harmful, as they bring about not only defects of a very unpleasant nature, when the wiredrawn products are used as such, or printed without bottom layer, but also structural defects either at the time of wiredrawing (ears or horns, ovalization of the containers), or during subsequent operations of d'ogivage or conification (folds, cracks, swellings) because of the very high anistropy of this basalt structure.

It is known that the principal piping of a cast part can be eliminated by the so-called feedhead technique, which consists of providing a supplementary space above the cast part, which forms a liquid metal reserve called "feedhead" to move the pipe or void to the upper part of the feedhead which eventually will be cut off and recast.

However, feedheading is a delicate operation for obtaining wiredrawing blanks. The diameter of the "neck" or "channel" of the casting, that is of the junction between the feedhead and the blank, plays an important part; if it is too large, it makes the later cutting off of the feedhead more difficult; at best, if it is equal to the diameter of the blank, this would amount to producing the blanks by cutting from a cast billet; if it is too narrow, there is danger of its solidification ahead of the blank itself and the feedhead can no longer play its part, thus there is a pipe even within the blank and another one on the feedhead.

The applicants also determined that the best method for furnishing blanks, in accordance with the quality standards just indicated (fineness and homogeneity of the grain, crystalline structure with axial symmetry, absence of internal defects), consists of combining the methods of casting by gravity in a metallic mold cooled from the bottom with the application of a moderated pressure on the feedhead during the solidification, said pressure being obtainable simply, but not exclusively, by compressed air.

The following figures and examples will make it possible to better understand and specify the range of the invention and its embodiment, without, however, constituting thereby any kind of limitation:

FIG. 1 shows in vertical axial sectional view a mold which makes it possible to obtain wiredrawing blanks according to the invention.

Figure 1:
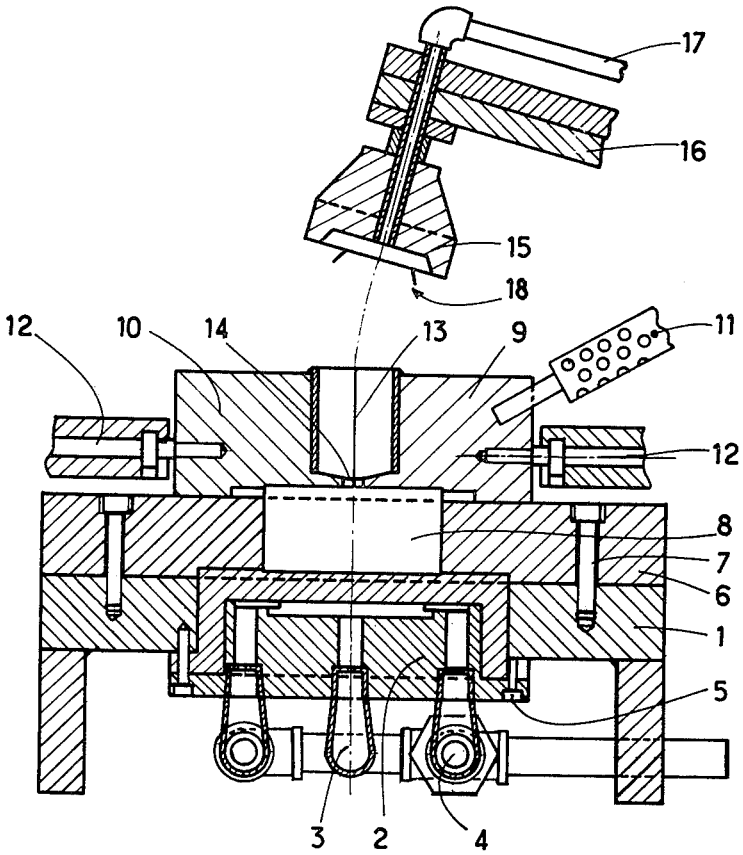
FIG. 1 is a vertical sectional view along the axis of a mold which makes it possible to obtain blanks according to the invention.

The frame 1 supports a bottom 2 cooled by a circulation of water, compressed air, a water-air emulsion or of an appropriate cooling fluid. The cooling fluid normally arrives at the center 3, and leaves at the periphery 4, but the reversed arrangement also is possible. The bottom 2 is fastened to the frame 1 by the screws 5. The body of the mold 6, which includes the location 8 of the blank, is fastened to the frame by screws 7. The mold is topped by two covers 9 and 10 which can be displaced laterally into joining contact and be separated by jacks 12. A blowpipe 11, operated with gas or an equivalent heating means, electricity for example, makes it possible to preheat the covers during the initial castings and, if necessary, to keep them at the desired temperature during the operation, so that the metal of the feedhead 13 can be controlled to its solid state after the blank itself. A cap 15, supported by an articulated arm 16, may be applied to the lids in a sealed manner in order to apply pressure to the feedhead 13 by compressed air, the air being supplied by a pipe 17. A deflector 18 makes it possible, if necessary, to prevent the flux of compressed air from only acting at the center of the feedhead 13, and from blowing the molten metal toward the periphery.

EXAMPLE 1

The cap 15 being lifted, both covers 9 and 10 having been moved into sealing engagement, and preheated to 300°–350°C, a sufficient quantity of 99.5 percent aluminum is introduced into the mold 8, said aluminum being refined by previous addition of 0.30 percent by weight of the product called Aluflux T, a mixture of fluoborate and potassium fluotitanate, at a temperature of 714°–740°C, so that the feedhead 13 occupies approximately one fourth to three fourths of the space available between the covers 9 and 10. Due to the circulation of cooling fluid in circuit 3 and 4, the total solidification of the blank is fast, and requires 40 to 45 seconds for 3 kilograms of aluminum, for example.

After the removal from the mold and the cooling, the blank-feedhead assembly is truncated along a vertical surface passing through the axis, one of the sides is polished and attacked with a macrographic reagent to expose its grain.

Figure 2:
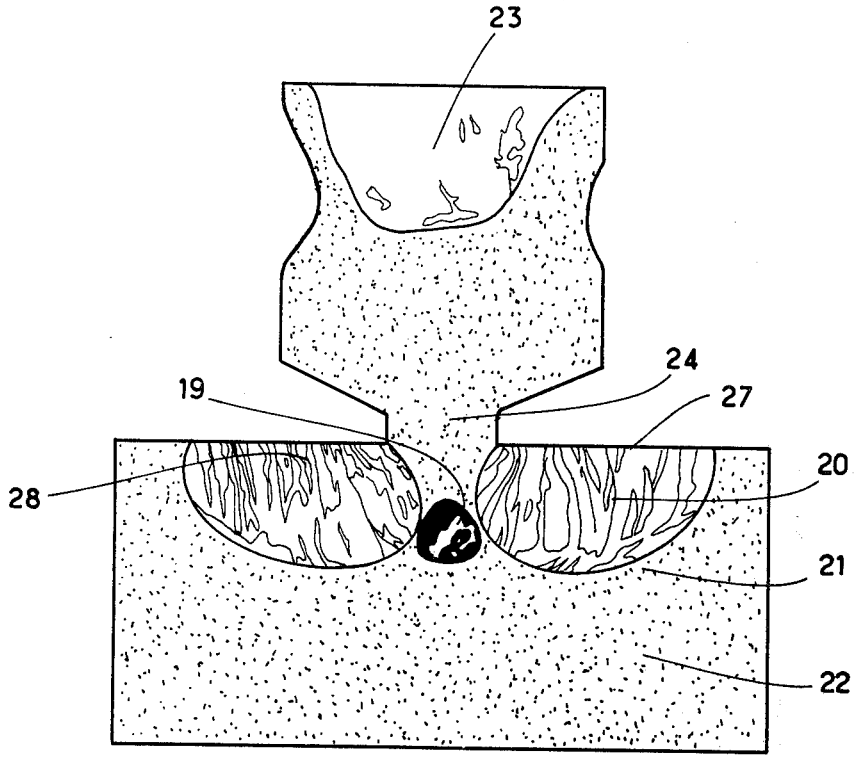
FIG. 2 is a vertical axial sectional view of a blank solidified without pressure, according to a method which is not according to the invention.

FIG. 2 shows a vertical axial sectional view of a blank-feedhead assembly prepared as was just described.

The blank has three principal defects: a considerable pipe 19 which shows that the casting channel 24 solidified too early and that the feedhead did not play its part, a considerable annular zone 20 of a basalt structure, an intermediate zone 21 where the size of the grains is very heterogeneous and a fine and homogeneous grain zone 22. The pipe or pinhole 23 of the feedhead is normal and by the way unimportant, because it will be truncated later, flush with the blank.

EXAMPLE 2

In the same mold 8, whose cap 15 has been lifted and the lids have been moved into sealing engagement and preheated to 300°–350°C, about 3 kilograms 99.5 percent aluminum are introduced, which were refined by preceding addition of 0.30 percent by weight of Aluflux T, at a temperature of 710°–740°C. After the introduction of the aluminum has been completed, one waits 10–15 seconds to allow the solidification to be primed, then with the aid of the cap 16 applied sealingly to the covers 9 and 10, an air pressure of 0.5 bar is applied for 1 minute and 30 seconds. Then the cap is lifted, the covers are separated, the blank-feedhead is removed from the mold, and truncated like in Example 1, along a vertical surface passing through the axis, which is prepared so as to expose its grain.

Figure 3:
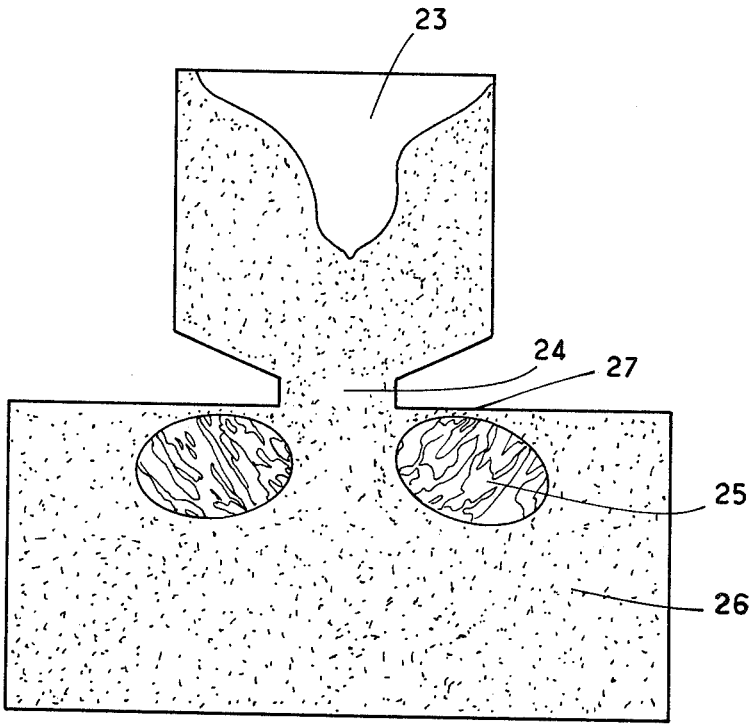
FIG. 3 is a vertical axial sectional view of a blank solidified at a pressure of 0.5 bars, according to a method in line with the invention.

FIG. 3 shows in a vertical axial sectional view, a blank-feedhead assembly prepared according to Example 2. The following is noted: the pipe or pinhead 23 of the feedhead remains, which is normal, with a slightly different shape, more narrow and deeper than in FIG. 2; the blank itself has no longer any pipe or pinhead, the basalt zones 20 of FIG. 2 have practically disappeared and there is no more than one annular zone 25, of small extent, where the crystallization is slightly rougher, with a general inclination of about 45° in relation to the casting axis, the remainder of the blank 26 has a remarkably fine and homogeneous grain, even in zone 27 on either side of the neck, in contact with the upper wall of the mold, which in Example 1 and in FIG. 2 was affected by the basalt structure.

The applicants have discovered that the effect of a moderate pressure, and particularly an air pressure during the solidification systematically and in perfectly reproducible form led to the structural improvements just described and this for blanks of a unitary weight from a few grams to several kilograms.

The applicants also discovered that the most favorable pressure ranges from 0.1 to 5 bars and preferably from 0.2 to 1 bar. Too high pressure values could cause an expulsion of the still molten metal from the mold.

While this does not constitute a characteristic or limitation of the invention, one might believe that the effect of the pressure being applied, at the time when the solidification has begun, can be explained in the following manner.

The solidification starts at the bottom of the blank which is closest to the cooling circuit and normally terminates at the upper zone on either side of the neck, which benefits from the heat flow of the metal of the feedhead and the heating of the covers. The waiting time prior to the application of pressure approximately corresponds with the formation of zone 22 of FIG. 2, where the crystallization is fine and homogeneous. Then crystalline germs appear, in contact with the upper wall 27, which tend to grow vertically and downward in the direction of the heat gradient; at the same time the neck begins to solidify. If this process is allowed to develop, the neck completes its solidification, the feedhead can no longer feed the blank with molten metal. The pipe or pinhead begins to form, while the crystalline germs continue to grow downward, from 27 to form the so-called basalt zone.

Figure 4:
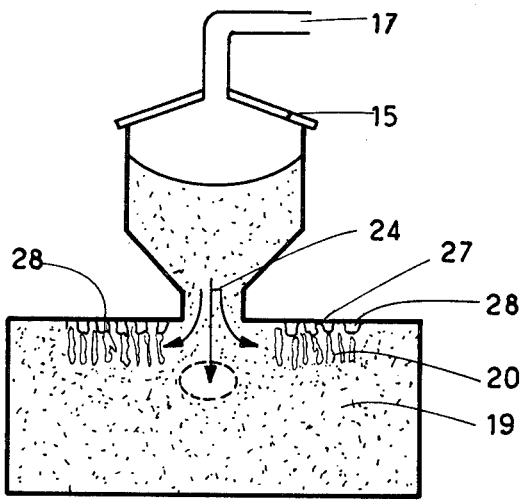
FIG. 4 is a sectional view which shows the direction of the circulation flow of the liquid aluminum alloy at the moment where pressure is applied to the feedhead.

If, on the other hand, pressure is exerted on the feedhead, while the beginning solidification has already caused a contraction of the blank, a flow of molten metal is created immediately from the feedhead toward the blank, at a pressure which apparently is equal to the air pressure of 0.5 bar, multiplied by the ratio of the surface of the feedhead by the surface of the neck, which may be on the order of 10 to 100. Under this effect, the molten aluminum is moved violently in the directions indicated by the arrows of FIG. 4 and exerts at least three effects: a mechanical effect which unhooks the crystallization primings 28 on the upper wall 27, breaks and dislodges the basalt structures 20 in formation, a heat effect which delays the solidification of the neck 24 and an effect of filling the pinholes like 19, which had begun to form in the blank.

Figure 5:
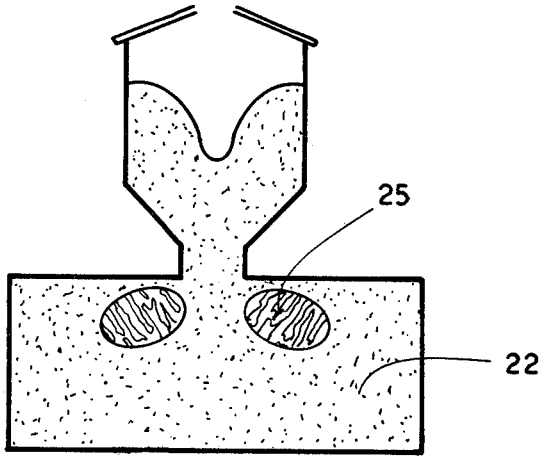
FIG. 5 is a diagrammatic showing of the structure of a blank modified by application of a pressure during the solidification.

FIG. 5 shows, in diagram form, the modified structure after the injection of this molten aluminum mass under the effect of pressure.

Comparative tests were carried out on blanks of the same dimensions, obtained by cutting rolled 99.5% aluminum strips (quality called A5) and on blanks cast according to the invention from 99.5% aluminum (quality called A5) and from so-called "second melting" aluminum, titrating 99% in Al and containing various elements of addition, particularly Fe, Si and Mg.

After withdrawing the three types of blanks under identical conditions, traction test pieces were cut in the walls of the drawn cases.

Taking the coefficient 100 for the mechanical characteristics of the wiredrawn products originating from rolled sheets, the following results were obtained:

| | rolled blank 99.5% Al | blank cast according to the invention 99.5% Al | Al 2nd melting |
|---|---|---|---|
| Elastic limit taken as a basis | 100 | 110/115 | 135/145 |
| Break load taken as a basis | 100 | 115/120 | 140/150 |

The following characteristics were measured in finished aerosol bombs, obtained under identical conditions from rolled blanks and from blanks cast according to the invention:

| | rolled blanks 99.5% Al | blanks cast according to the invention 99.5% Al | Al 2nd melting |
|---|---|---|---|
| Pressure of first deformation taken as a basis | 100 | 110/115 | 135/140 |
| Bursting pressure taken as a basis | 100 | 115/125 | 140/145 |

These important gains of mechanical characteristics, together with a practical zero rate of rejects, make it possible to manufacture with blanks of the same dimension, aerosol bombs or all other containers which must resist an internal pressure, which perform better, permit higher internal pressures or assure greater security against shocks or elevations of temperature, or to manufacture these containers with thinner walls for an unchanged safety coefficient, which is particularly useful for autonomous breathing equipment, like sub sea level diving equipment or interventions in unbreathable surroundings, or liquid butane cartridges for portable heating and lighting equipment for which relief is sought without compromising safety.

The present invention relates to new blanks with improved structure of aluminum or aluminum-based alloys, intended for fabrication by processes of wiredrawing and particularly wiredrawing by shock or impact, of very diverse containers, like tubes, boxes, packaging material, aerosol bombs, extinguisher bodies, bottle or cartridge bodies for compressed or liquefied gases. It also relates to the method for obtaining these blanks by gravity casting in a metal mold cooled with the application of moderate pressure during the solidification of the metal.

It adapts itself particularly well to the automation of the method of producing blanks at high production rates, within a range of weights ranging from a few grams to several kilograms.

We claim:

1. Blanks for impact extrusion in which the blanks are formed of aluminum alloy subjected to a previous refining treatment, characterized by a fine, dense crystalline structure with axial symmetry, which is substantially homogeneous and by a reduced extension of the rough basaltic crystallization which at no point reaches the peripheral zone of the blank.

* * * * *